US011320108B2

(12) United States Patent
Nishimura

(10) Patent No.: US 11,320,108 B2
(45) Date of Patent: May 3, 2022

(54) LIGHTING TOOL FOR VEHICLE

(71) Applicant: STANLEY ELECTRIC CO., LTD., Tokyo (JP)

(72) Inventor: Shota Nishimura, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/207,809

(22) Filed: Mar. 22, 2021

(65) Prior Publication Data

US 2021/0301995 A1 Sep. 30, 2021

(30) Foreign Application Priority Data

Mar. 24, 2020 (JP) ..... JP2020-053271

(51) Int. Cl.

| | |
|---|---|
| ***F21S 41/265*** | (2018.01) |
| *F21W 107/10* | (2018.01) |
| *F21W 102/155* | (2018.01) |
| *F21S 41/143* | (2018.01) |
| *F21S 41/24* | (2018.01) |
| *F21S 41/255* | (2018.01) |
| *F21S 41/148* | (2018.01) |
| *F21S 41/32* | (2018.01) |

(52) U.S. Cl.

CPC ..... *F21S 41/265* (2018.01); *F21S 41/143* (2018.01); *F21S 41/148* (2018.01); *F21S 41/24* (2018.01); *F21S 41/255* (2018.01); *F21S 41/322* (2018.01); *F21W 2102/155* (2018.01); *F21W 2107/10* (2018.01)

(58) Field of Classification Search

CPC ..... F21S 41/25; F21S 41/255; F21S 41/26; F21S 41/265; F21S 41/27; F21S 41/24; F21S 41/143; F21S 41/148; F21S 41/322

See application file for complete search history.

(56) References Cited

U.S. PATENT DOCUMENTS

| | | | | |
|---|---|---|---|---|
| 9,500,334 | B2 * | 11/2016 | Iwasaki | F21S 41/143 |
| 9,644,810 | B2 * | 5/2017 | Yamamoto | F21S 43/31 |
| 2003/0072167 | A1 * | 4/2003 | Albou | F21S 41/255 362/543 |
| 2013/0027961 | A1 * | 1/2013 | Ugajin | F21S 41/26 362/538 |
| 2013/0163265 | A1 * | 6/2013 | Abe | F21S 41/143 362/512 |
| 2013/0163268 | A1 * | 6/2013 | Okubo | F21S 41/143 362/520 |
| 2013/0163269 | A1 * | 6/2013 | Abe | F21S 41/683 362/520 |
| 2015/0009700 | A1 * | 1/2015 | Yamamoto | F21S 43/26 362/538 |

(Continued)

FOREIGN PATENT DOCUMENTS

JP 2018-18590 A 2/2018

*Primary Examiner* — Zheng Song

(74) *Attorney, Agent, or Firm* — Kenealy Vaidya LLP

(57) ABSTRACT

A lighting tool for a vehicle includes a light source, and a projection lens configured to project light emitted from the light source forward, a light distribution pattern including a cutoff line at an upper end is formed with the light projected forward of the projection lens, and a refractive surface configured to refract some of the light projected forward of the projection lens in a specific direction is provided on a light emission surface of the projection lens.

9 Claims, 10 Drawing Sheets

(56) References Cited

U.S. PATENT DOCUMENTS

| | | | | |
|---|---|---|---|---|
| 2015/0300589 | A1* | 10/2015 | Iwasaki | F21S 41/143<br>362/520 |
| 2016/0025291 | A1* | 1/2016 | Iwasaki | F21S 41/265<br>362/516 |
| 2016/0102831 | A1* | 4/2016 | Okubo | F21S 41/19<br>362/512 |
| 2017/0299137 | A1* | 10/2017 | Kinoshita | F21S 41/365 |
| 2017/0343173 | A1* | 11/2017 | Takada | F21S 41/338 |
| 2019/0117675 | A1* | 4/2019 | Kim | A61K 31/575 |
| 2019/0226658 | A1* | 7/2019 | Kawai | F21S 41/285 |
| 2019/0242543 | A1* | 8/2019 | Guan | F21S 41/255 |
| 2019/0331309 | A1* | 10/2019 | Kuwata | F21S 41/265 |

* cited by examiner

LIGHTING TOOL FOR VEHICLE

CROSS-REFERENCE TO RELATED APPLICATION

Priority is claimed on Japanese Patent Application No. 2020-053271, filed Mar. 24, 2020, the content of which is incorporated herein by reference.

BACKGROUND OF THE INVENTION

Field of the Invention

The present invention relates to a lighting tool for a vehicle.

Description of Related Art

For example, a lighting tool for a vehicle such as a headlight (headlamp) for a vehicle or the like includes a light source, a reflector configured to reflect light emitted from the light source in a direction of advance of a vehicle, a shade configured to shield (cut) some of the light reflected by the reflector, and a projection lens configured to project the light, some of which is cut by the shade in the direction of advance of the vehicle.

In such a lighting tool for a vehicle, as a passing beam (low beam), a light distribution pattern for a low beam including a cutoff line at an upper end is formed by inverting and projecting a light source image defined by a front end of the shade by the projection lens.

Incidentally, in the above-mentioned lighting tool for a vehicle, since the light, some of which is cut by the shade, is projected in the direction of advance of the vehicle, there was a problem such that the cutoff line defined by the front end of the shade becomes too sharp. That is, in the light distribution pattern for a low beam, in order to prevent the degree of gradient of the light intensity cross section (light intensity distribution) at the specified position that crosses the cutoff line referred to as a G value from becoming higher than a reference value of laws and regulations, it is necessary to appropriately blur a brightness boundary of the cutoff line.

In order to solve the above-mentioned problems, the invention disclosed in Japanese Unexamined Patent Application, First Publication No. 2018-018590 discloses a lighting tool for a vehicle including a first light source configured to emit first light, a first reflection member configured to reflect the first light downward in a direction of advance of a vehicle, a second reflection member configured to reflect some of the first light reflected by the first reflection member upward in the direction of advance of the vehicle, a second light source disposed below the second reflection member and configured to emit second light in the direction of advance of the vehicle, and a projection lens configured to project the first light and the second light in the direction of advance of the vehicle, the second light source having a plurality of light emitting elements disposed next to each other in a direction corresponding to at least a vehicle width direction in two directions corresponding to a vehicle height direction and the vehicle width direction, and the projection lens having a lower region through which the first light reflected by the first reflection member downward in the direction of advance of the vehicle passes, an upper region through which the first light reflected by the second reflection member upward in the direction of advance of the vehicle passes, a first diffusing surface located between the lower region and the upper region, disposed to correspond to the lower region among an intermediate region through which the second light emitted from the second light source passes, and configured to diffuse the first light in the vehicle height direction and the vehicle width direction, a second diffusing surface disposed to correspond to the upper region and configured to diffuse the first light in the vehicle height direction and the vehicle width direction, and a third diffusing surface disposed to correspond to the intermediate region and configured to diffuse the second light in the vehicle height direction and the vehicle width direction.

In the invention disclosed in Japanese Unexamined Patent Application, First Publication No. 2018-018590, by diffusing the first light entered the above-mentioned first diffusing surface and second diffusing surface in a height direction (upward/downward direction) of the vehicle, it is possible to obtain a good light distribution pattern for a low beam while preventing a G value from becoming higher than a reference value of laws and regulations and while appropriately blurring a brightness boundary of a cutoff line.

SUMMARY OF THE INVENTION

Meanwhile, in the invention disclosed in Japanese Unexamined Patent Application, First Publication No. 2018-018590, by blurring the brightness boundary of the cutoff line in the upward/downward direction, a reference point based on laws and regulations is located in the cutoff line blurred in the upward/downward direction, and there is a possibility in that the light intensity at the reference point becomes higher than the reference value.

Further, specific laws and regulations include exemplarily US laws and regulations, those of the Insurance Institute for Highway Safety (IIHS), and the like. In addition, laws and regulations include Japanese laws and regulations, foreign laws and regulations, and laws and regulations changing in the future in each country.

An aspect of the present invention provides a lighting tool for a vehicle capable of providing a good light distribution pattern.

In order to accomplish the above-mentioned purposes, the present invention provides the following means.

[1] A lighting tool for a vehicle including:

a light source; and a projection lens configured to project light emitted from the light source forward, wherein a light distribution pattern including a cutoff line at an upper end is formed with the light projected forward of the projection lens, and a refractive surface configured to refract some of the light projected forward of the projection lens in a specific direction is provided on a light emission surface of the projection lens.

[2] The lighting tool for a vehicle according to the above-mentioned [1], wherein the refractive surface is configured to refract light upward and to refract light toward one side in a horizontal direction with respect to an advancing direction of the light emitted from the light emission surface.

[3] The lighting tool for a vehicle according to the above-mentioned [1], wherein the refractive surface is configured to refract light toward one side in a horizontal direction with respect to an advancing direction of the light emitted from the light emission surface and includes a diffusion section configured to diffuse light in a vertical direction.

[4] The lighting tool for a vehicle according to any one of the above-mentioned [1] to [3], wherein the light emission surface of the projection lens configures a convex lens surface, and the refractive surface is provided in a lower region of the light emission surface.

[5] The lighting tool for a vehicle according to any one of the above-mentioned [2] to [4], wherein, in a case a vehicle travels according to a right-hand side lane traffic, the refractive surface refracts light rightward with respect to the advancing direction of the light emitted from the light emission surface.

[6] The lighting tool for a vehicle according to any one of the above-mentioned [2] to [4], wherein, in a case a vehicle travels according to a left-hand side lane traffic, the refractive surface refracts light leftward with respect to the advancing direction of the light emitted from the light emission surface.

[7] The lighting tool for a vehicle according to any one of the above-mentioned [1] to [6], wherein the refractive surfaces refract light in same direction in the respective projection lenses included in a pair of lighting tools for a vehicle mounted on both of left and right sides on a front end side of a vehicle.

[8] The lighting tool for a vehicle according to any one of the above-mentioned [1] to [7], wherein the projection lens has a shape in which the light emission surface is inclined in a direction in which other end side in a horizontal direction is retracted than one end side in a horizontal direction with respect to an advancing direction of the light emitted from the light emission surface so as to match a slant shape applied at a corner section on a front end side of a vehicle, and the refractive surfaces have an asymmetrical shape between the respective projection lenses included in a pair of lighting tools for a vehicle mounted on both of left and right sides of a front end side of a vehicle.

According to the aspect of the present invention, it is possible to provide a lighting tool for a vehicle capable of providing a good light distribution pattern.

DETAILED DESCRIPTION OF THE INVENTION

Figure 1A:
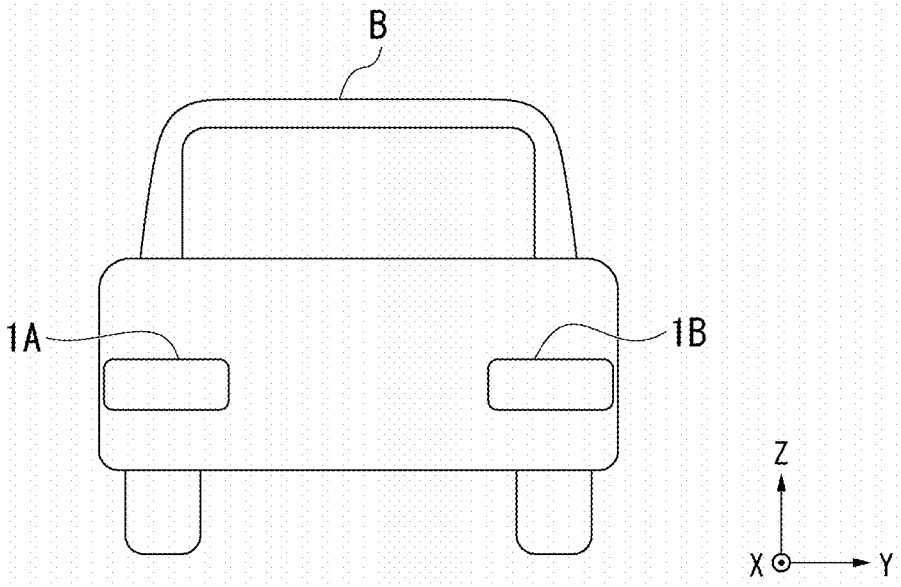
FIG. 1A is a front view of a vehicle including a lighting tool for a vehicle according to an embodiment of the present invention.

Hereinafter, an embodiment of the present invention will be described in detail with reference to the accompanying drawings.

Further, in the drawings used in the following description, in order to make components easier to see, the dimensional scale may vary depending on the components, and dimensional ratios between the components are not always the same as actual ones.

In addition, in the drawings described below, an XYZ orthogonal coordinate system is set, an X-axis direction indicates a forward/rearward direction (a lengthwise direction) of a lighting tool for a vehicle, a Y-axis direction indicates a leftward/rightward direction (a widthwise direction) of the lighting tool for a vehicle, and a Z-axis direction indicates an upward/downward direction (a height direction) of the lighting tool for a vehicle.

As an embodiment of the present invention, for example, lighting tools 1A and 1B for a vehicle shown in FIG. 1A and FIG. 1B will be described.

Figure 1B:
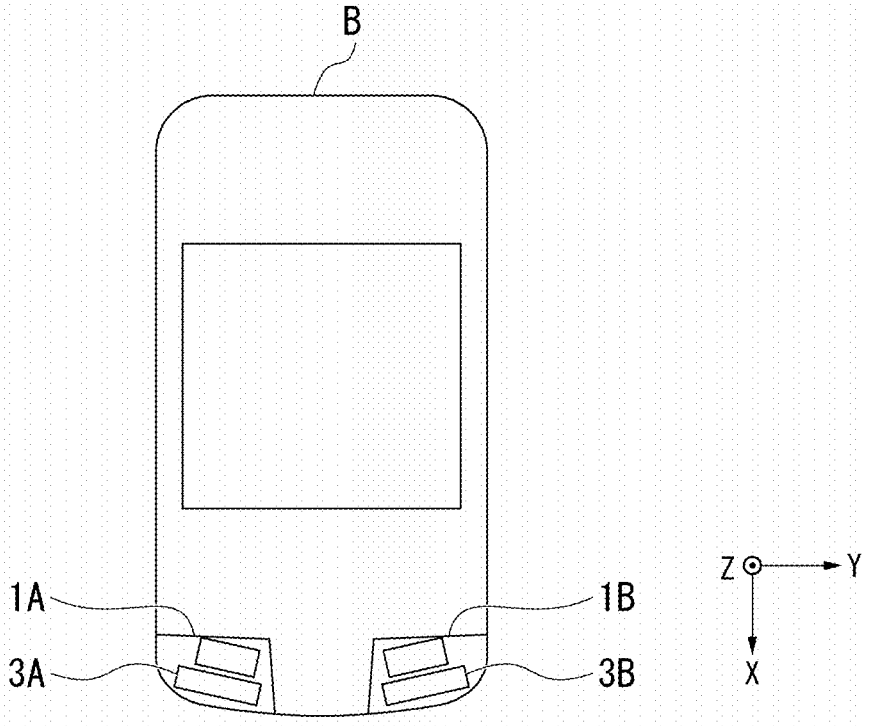
FIG. 1B is a top view of the vehicle including the lighting tool for a vehicle according to the embodiment of the present invention.

Further, FIG. 1A is a front view of a vehicle B including the lighting tools 1A and 1B for a vehicle, and FIG. 1B is a top view of the vehicle B including the lighting tools 1A and 1B for a vehicle.

The lighting tools 1A and 1B for a vehicle of the embodiment are obtained by applying the present invention to a pair of headlights (headlamps) for a vehicle mounted on both of left and right sides on the side of a front end of the vehicle B, for example, as shown in FIG. 1A and FIG. 1B. The lighting tool 1A for a vehicle, which is one of these, constitutes a headlight for a vehicle on the right side of the vehicle, and the other lighting tool 1B for a vehicle constitutes a headlight for a vehicle on the left side of the vehicle.

The one lighting tool 1A for a vehicle and the other lighting tool 1B for a vehicle are made to match a slant shape applied to corner sections on the side of the front end of the vehicle B, and provided to be inclined in a direction in which an outward side of the lighting tool is retracted further than an inward side in a vehicle width direction, in a direction of advance of the vehicle B.

In the embodiment, first, a configuration of one of the lighting tools 1A for a vehicle shown in FIG. 2A to FIG. 8B will be exemplarily described.

Figure 2A:
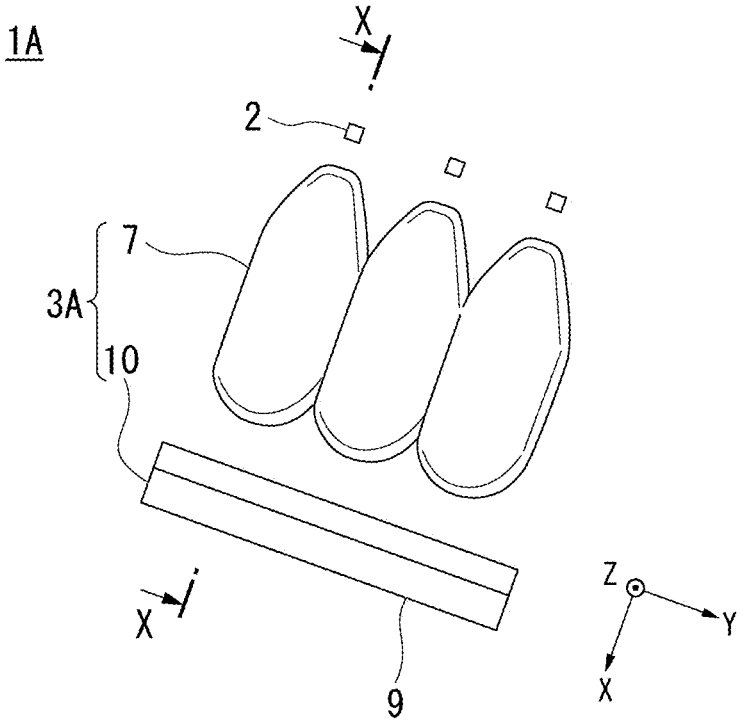
FIG. 2A is a plan view of a configuration of one of the lighting tools for a vehicle shown in FIG. 1A and FIG. 1B.
Figure 2B:
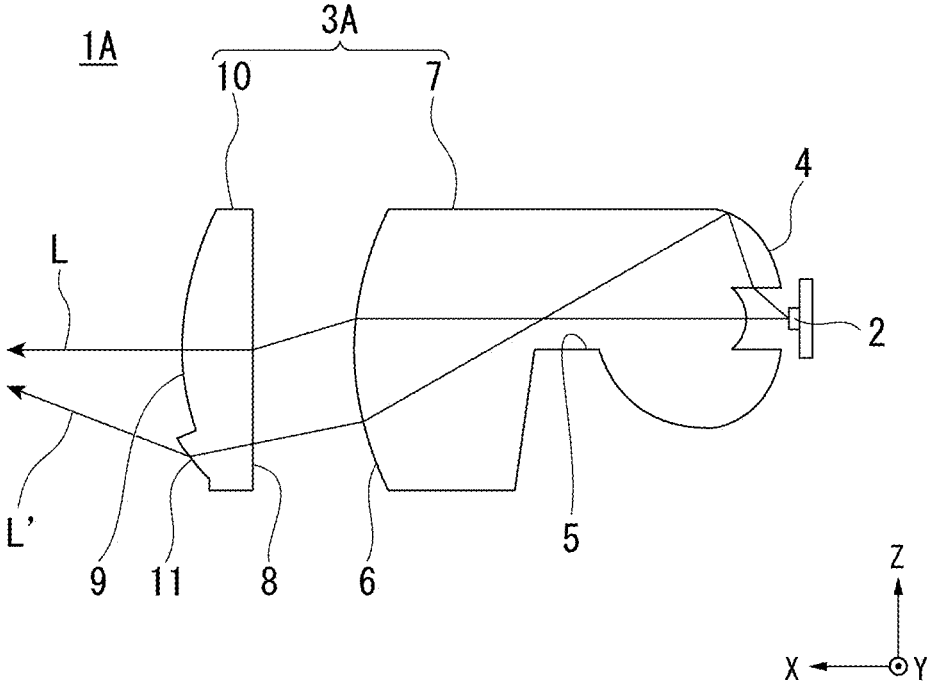
FIG. 2B is a cross-sectional view of the one of the lighting tools for a vehicle shown in FIG. 1A and FIG. 1B.
Figure 3:
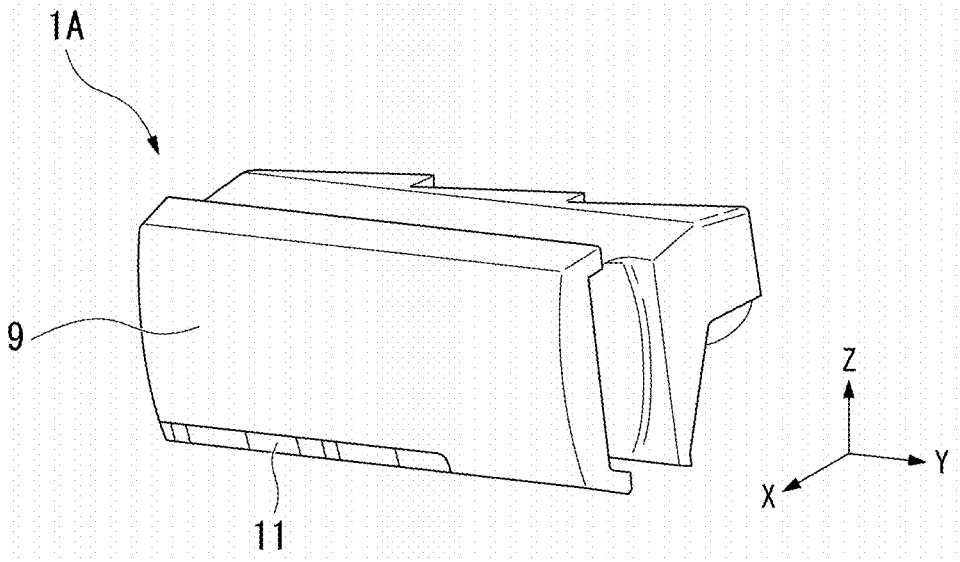
FIG. 3 is a perspective view showing a configuration of a projection lens included in the one of the lighting tools for a vehicle shown in FIG. 1A and FIG. 1B.
Figure 4:
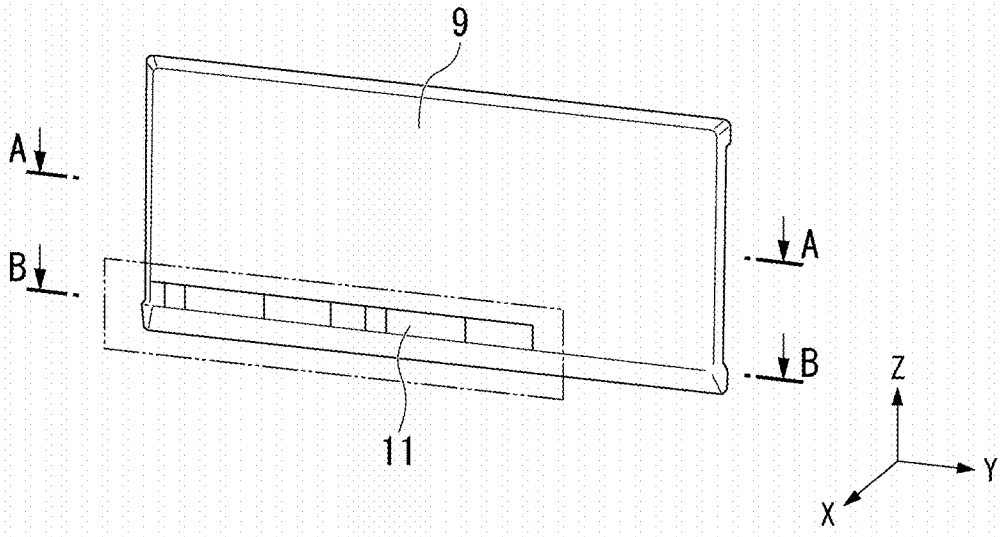
FIG. 4 is a perspective view showing a light emission surface of the projection lens shown in FIG. 2A and FIG. 2B.
Figure 5:
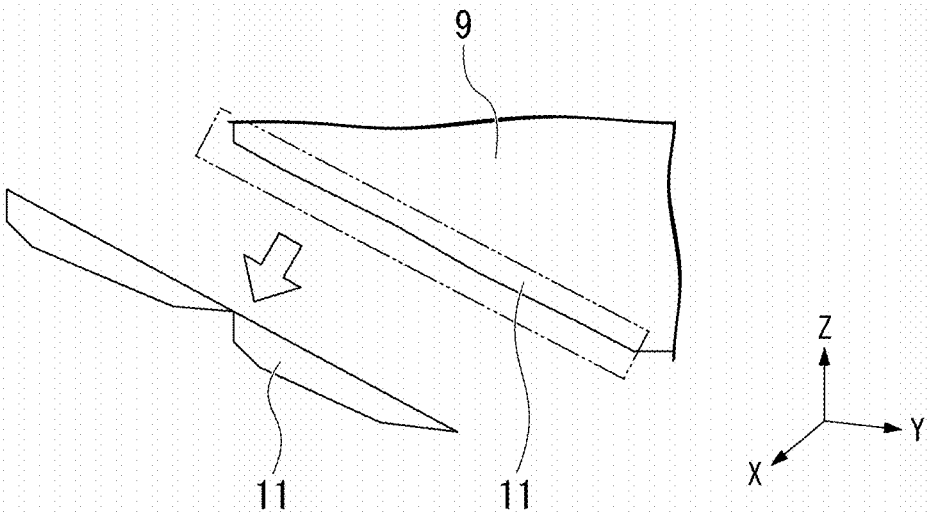
FIG. 5 is an enlarged perspective view showing a refractive surface shown in FIG. 3.
Figure 6A:
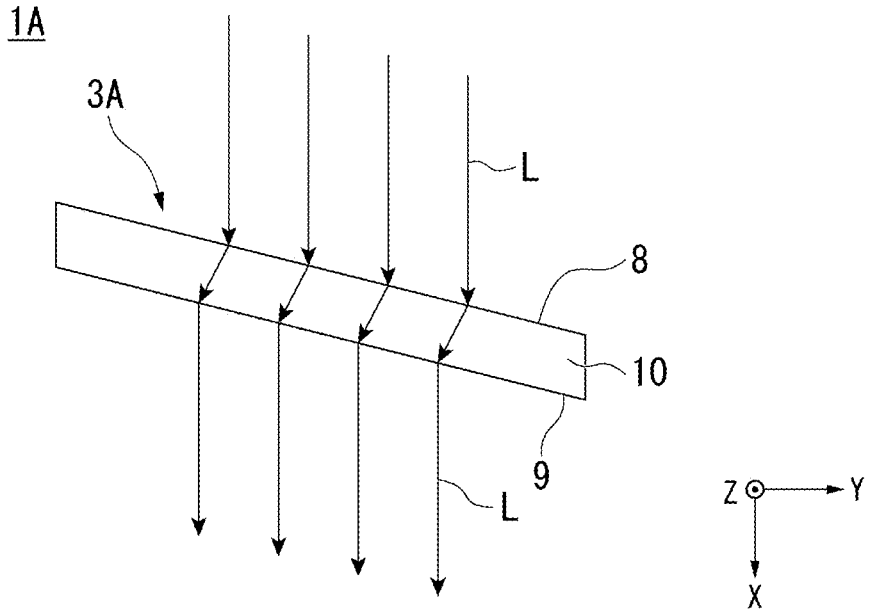
FIG. 6A is a schematic view showing an optical path of light projected toward a side in front of the projection lens, in a horizontal cross section along a line segment A-A shown in FIG. 4.
Figure 6B:
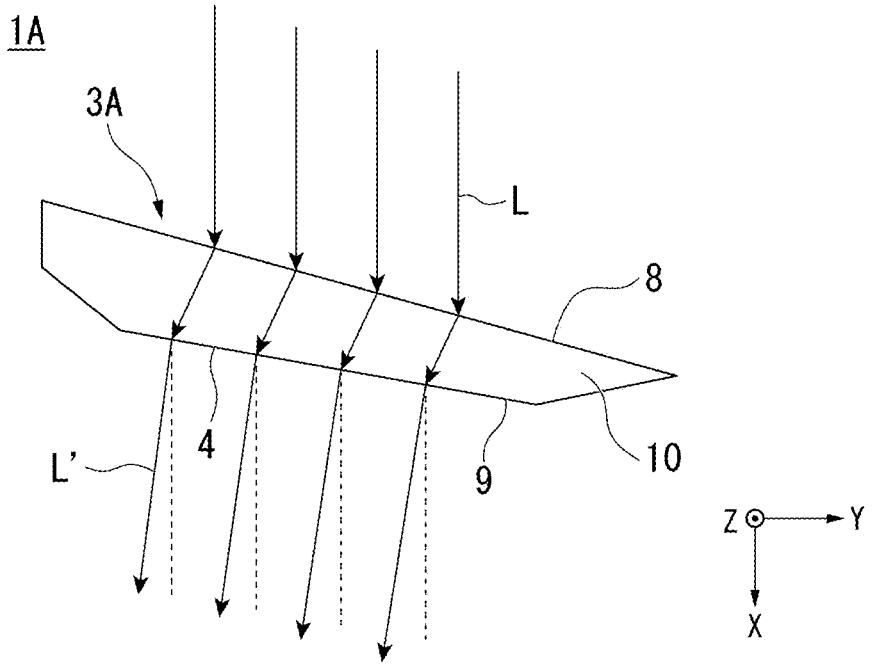
FIG. 6B is a schematic view showing an optical path of light projected toward a side in front of the projection lens, in a horizontal cross section of a line segment B-B shown in FIG. 4.
Figure 7A:
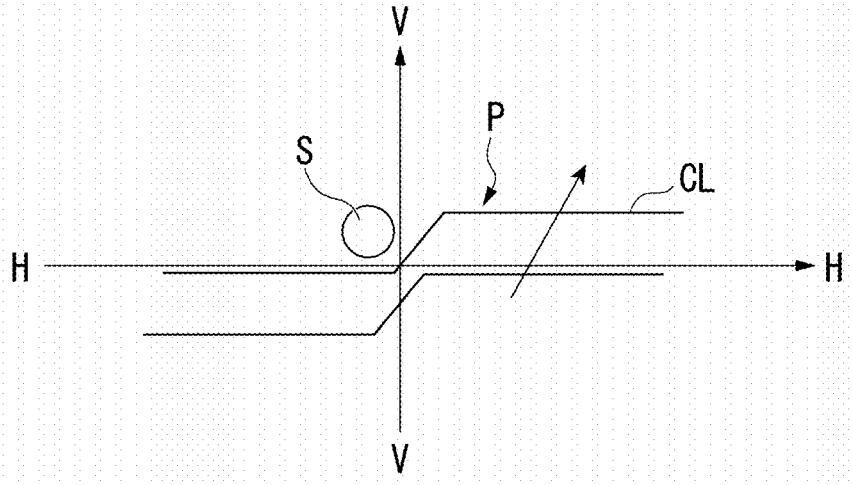
FIG. 7A is a schematic view showing a light distribution pattern for a low beam of light projected toward a side in front of the projection lens in a case a refractive surface is provided according to right-hand side lane traffic.
Figure 7B:
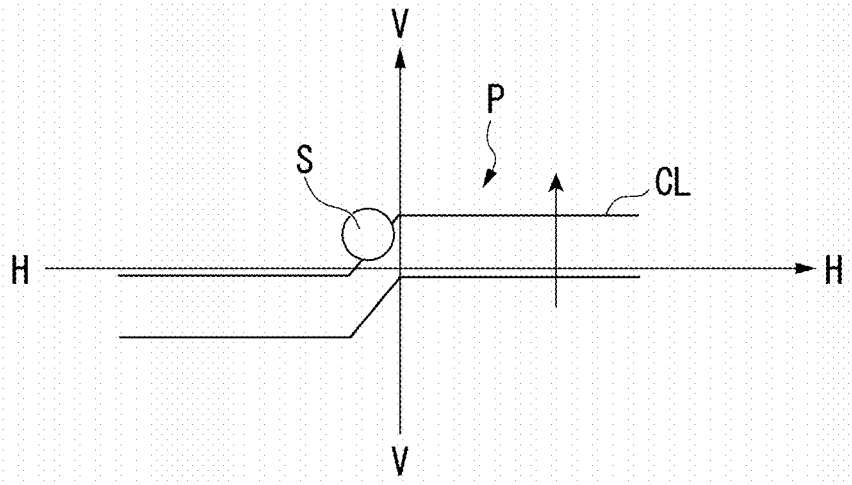
FIG. 7B is a schematic view showing a light distribution pattern of a low beam of light projected toward a side in front of the projection lens in a case the refractive surface is not provided.
Figure 7C:
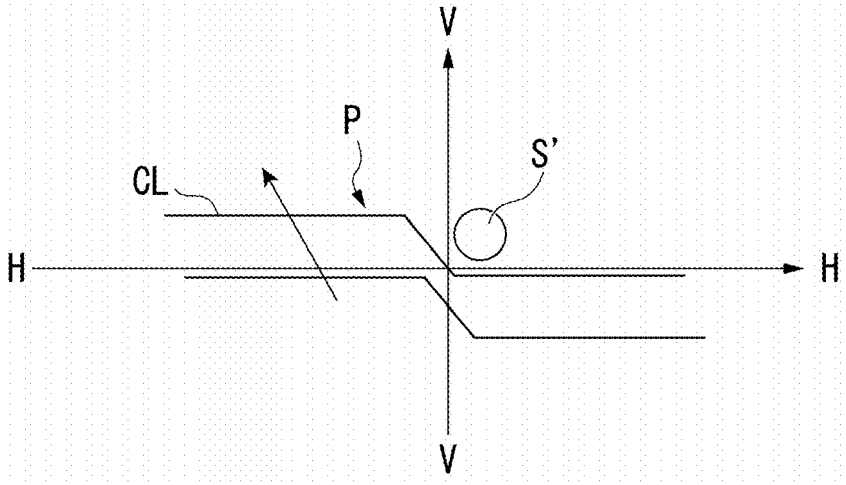
FIG. 7C is a schematic view showing a light distribution pattern of a low beam of light projected toward a side in front of the projection lens in a case the refractive surface is provided according to left-hand side lane traffic.
Figure 8A:
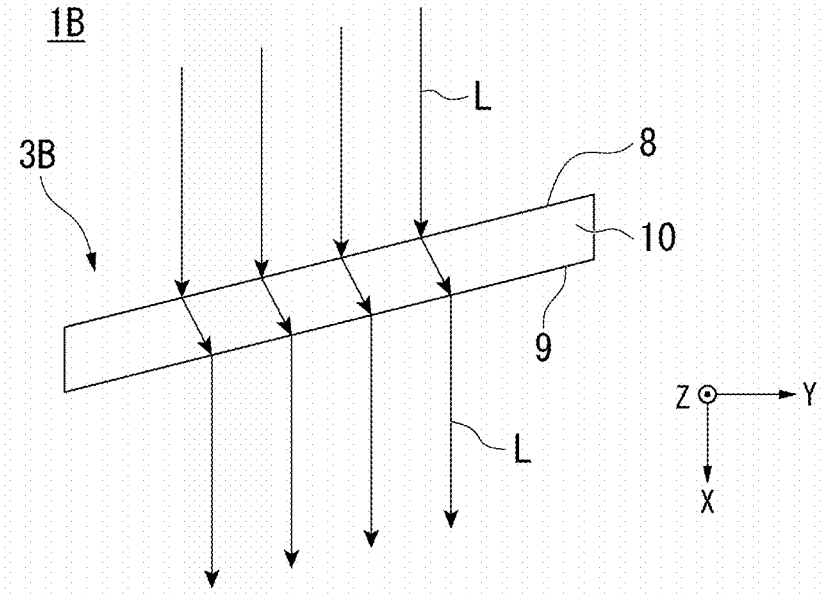
FIG. 8A is a schematic view showing a configuration of a projection lens included in the other lighting tool for a vehicle shown in FIG. 1A and FIG. 1B, and showing an optical path of light projected toward a side in front of the projection lens in a horizontal cross section along a line segment A-A shown in FIG. 4.
Figure 8B:
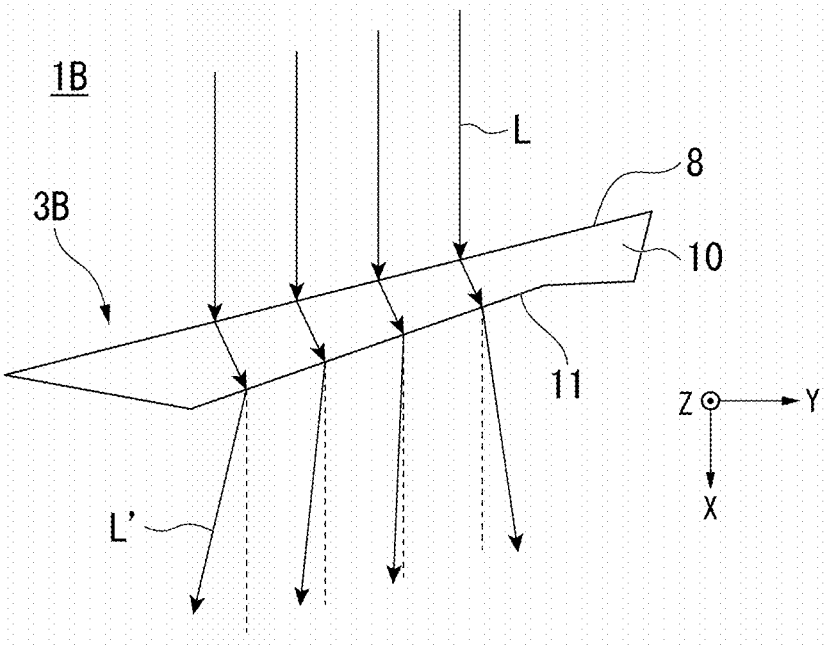
FIG. 8B is a schematic view showing a configuration of the projection lens included in the other lighting tool for a vehicle shown in FIG. 1A and FIG. 1B, and showing an optical path of light projected toward a side in front of the projection lens in a horizontal cross section along a line segment B-B shown in FIG. 4.

Further, FIG. 2A is a plan view of a configuration of the one lighting tool 1A for a vehicle, and FIG. 2B is a cross-sectional view by a line segment X-X shown in FIG. 2A. FIG. 3 is a perspective view showing a configuration of a projection lens 3A included in the one lighting tool 1A for a vehicle. FIG. 4 is a perspective view showing a light emission surface 9 of the projection lens 3A. FIG. 5 is an enlarged perspective view showing a refractive surface 11. FIG. 6A is a schematic view showing an optical path of light L projected toward a side in front of the projection lens 3A in a horizontal cross section along a line segment A-A shown in FIG. 4. FIG. 6B is a schematic view showing optical paths of lights L and L' projected toward a side in front of the projection lens 3A in a horizontal cross section along a line segment B-B shown in FIG. 4. FIG. 7A is a schematic view showing a light distribution pattern P for a low beam of lights L and L' projected to a side in front of the projection lens 3A when the refractive surface 11 is provided according to right-hand side lane traffic. FIG. 7B is a schematic view showing a light distribution pattern P for a low beam of light L projected toward a side in front of the projection lens 3A when the refractive surface 11 is not provided. FIG. 7C is a schematic view showing a light distribution pattern for a low beam of light projected toward a side in front of the projection lens 3A when the refractive surface 11 is provided according to left-hand side lane traffic. FIG. 8A is a schematic view showing an optical path of light L projected toward a side in front of the projection lens 3B in a horizontal cross section along a line segment A-A shown in FIG. 4 of a projection lens 3B included in the other lighting tool 1B for a vehicle. FIG. 8B is a schematic view showing optical paths of lights L and L' projected toward a side in front of the projection lens 3B in a horizontal cross section along a line segment B-B shown in FIG. 4 of the projection lens 3B included in the other lighting tool 1B for a vehicle.

As shown in FIG. 2A and FIG. 2B, the lighting tool 1A for a vehicle of the embodiment includes a light source 2, and the projection lens 3A configured to project light emitted from the light source forward.

For example, a light emitting element such as a light emitting diode (LED), a laser diode (LD), or the like, configured to emit white light can be used in the light source 2. Further, a type of the light source is not particularly limited and may use a light source other than the above-mentioned light emitting element. In addition, the number of the light source 2 is not limited to one and may be plural.

A material having a higher refractive index than that of air, for example, a transparent resin such as polycarbonate, acryl, or the like, glass, or the like, can be used in the projection lens 3A.

The projection lens 3A includes a first lens 7 in which a light incidence section 4, a reflecting surface 5 and a light emission surface 6 are sequentially disposed, and a second lens 10 in which a light incidence surface 8 and the light emission surface 9 are sequentially disposed, along a reference axis extending in a horizontal direction.

In the projection lens 3A, light L emitted from the light source 2 enters the first lens 7 from the light incidence section 4, and some of the light is reflected by the reflecting surface 5 and then emitted from the light emission surface 6 to the outside of the first lens 7. In addition, the light L emitted from the light emission surface 6 of the first lens 7 to the outside enters the second lens 10 from the light incidence surface 8, and then, is emitted from the light emission surface 9 to the outside of the second lens 10. Accordingly, the light L radiated to the side in front of the projection lens 3A is configured to form a light distribution pattern for a low beam including a cutoff line defined by a front end portion of the reflecting surface 5 at the upper end.

In addition, in the light emission surface 9 of the projection lens 3A, as shown in FIG. 3 and FIG. 4, the refractive surface 11 configured to refract some of the light L projected toward the side in front of the projection lens 3A in a specific direction is provided.

The refractive surface 11 is constituted by a cut surface configured to refract light toward one side (a rightward side) in the leftward/rightward direction (the horizontal direction) and configured to refract the light upward, with respect to a direction of advance of light emitted from the light emission surface 9. The refractive surface 11 is provided in a state being offset toward one side (rightward) in the leftward/rightward direction (the horizontal direction) from a position along a lower end portion of the light emission surface 9. Further, the refractive surface 11 has a cut surface shape as enlarged and shown in FIG. 5.

Specifically, the refractive surface 11 is provided in a region at the lower side of the light emission surface 9, and has a cut surface shape curved rearward so as to refract the light L entered the lower side of the light emission surface 9 upward. In addition, the refractive surface 11 is similar in shape to a lower region of the light emission surface 9 constituted by a lens surface curved in a convex shape. For this reason, providing the refractive surface 11 in the lower region of the light emission surface 9 makes it easier to refract the light L' upward while a forward protrusion of the refractive surface 11 is suppressed at a low level. Further, when the refractive surface 11 is provided at a position along a lower end portion of the light emission surface 9, it is possible to more easily refract the light L' upward.

In the one lighting tool 1A for a vehicle, as shown in FIG. 6A, when the vehicle B travels according to right-hand side lane traffic, as shown in FIG. 6B, the light L' refracted by the refractive surface 11 is projected toward the host lane (rightward) in a width direction of the vehicle B with respect to a direction of advance of the light L projected forward from the light emission surface 9 of the projection lens 3A.

The lighting tool 1A for a vehicle of the embodiment having the above-mentioned configuration forms a light distribution pattern P for a low beam including a cutoff line CL on an upper end as shown in FIG. 7A using the lights L and L' projected toward the side in front of the projection lens 3A.

Meanwhile, as a comparative example, when the refractive surface 11 is not provided on the light emission surface 9, the light distribution pattern P for a low beam formed by the light L projected toward the side in front of the projection lens 3A is shown in FIG. 6B.

As shown in FIG. 7A, when the light emission surface 9 is provided on the above-mentioned refractive surface 11, the cutoff line CL on the upward side is shifted toward the host lane (rightward) in the width direction of the vehicle B while the brightness boundary of the cutoff line CL is shifted upward by the light L' refracted by the refractive surface 11.

In this case, even when a reference point S of laws and regulations is located in the cutoff line CL shifted rightward and upward, since there is no blurred cutoff line CL, it is possible to prevent the light intensity of the reference point S from exceeding the reference value when the light intensity of the reference point S is measured. As a result, it is possible to obtain a good light distribution pattern P for a low beam.

In addition, the reference point S is located in the vicinity of a center that exceeds 0° of line V-V of the light intensity distribution and that is less than 0° of line H-H. Meanwhile, the reference point S is not limited to such a position and may be disposed in the vicinity of a center that exceeds 0° of line V-V and that exceeds 0° of line H-H.

In such case, by further shifting the cutoff line CL on the upward side toward the host lane (rightward) in the width direction of the vehicle B while shifting the brightness boundary of the cutoff line CL upward, even when the reference point S of laws and regulations is included, since there is no blurred cutoff line CL, it is possible to prevent the light intensity of the reference point S from exceeding the reference value when the light intensity of the reference point S is measured.

From the above, when the reference point S of laws and regulations is present in the vicinity of the center between line H-H and line V-V, it is possible to apply the present invention.

Meanwhile, as shown in FIG. 7B, when the refractive surface 11 is not provided on the light emission surface 9, the reference point S of laws and regulations is located in the cutoff line CL shifted upward, and the light intensity at the reference point S becomes higher than the reference value, which makes it incompatible with laws and regulations. Accordingly, it is difficult to obtain a good light distribution pattern P for a low beam.

In the one lighting tool 1A for a vehicle, when the vehicle B travels according to left-hand side lane traffic, the light L' refracted by the refractive surface 11 is projected toward the host lane (leftward) in the width direction of the vehicle B with respect to the direction of advance of the light L projected forward from the light emission surface 9 of the projection lens 3A. That is, a direction of the light L' refracted by the refractive surface 11 when the vehicle B travels according to left-hand side lane traffic is opposite to that when the vehicle B travels according to right-hand side lane traffic.

In this case, the light distribution pattern P for a low beam formed by the light L projected toward the side in front of the projection lens 3A is shown in FIG. 7C. As shown in FIG. 7C, even when a reference point S' of laws and regulations is located in the cutoff line CL shifted leftward and upward, since there is no blurred cutoff line CL, it is possible to prevent the light intensity of the reference point S' from exceeding the reference value when the light intensity of the reference point S' is measured. As a result, it is possible to obtain a good light distribution pattern P for a low beam.

In addition, the reference point S' is disposed in the vicinity of a center which exceeds 0° of line V-V and which exceeds 0° of line H-H. Meanwhile, the reference point S is not limited to such a position, and the reference point S' may be disposed in the vicinity of a center that is less than 0° of line V-V and that exceeds 0° of line H-H.

In such case, by further shifting the cutoff line CL on the upward side toward the host lane (leftward) in the width direction of the vehicle B while shifting the brightness boundary of the cutoff line CL upward, even when the reference point S' of laws and regulations is located in, since there is no blurred cutoff line CL, it is possible to prevent the light intensity of the reference point S' from exceeding the reference value when the light intensity of the reference point S' is measured.

Next, a configuration of the other lighting tool 1B for a vehicle shown in FIG. 8A and FIG. 8B will be described.

Further, in the other lighting tool 1B for a vehicle, FIG. 8A corresponds to a horizontal cross section along line segment A-A shown in FIG. 4, and FIG. 8B corresponds to a horizontal cross section along line segment B-B shown in FIG. 4.

The other lighting tool 1B for a vehicle includes a projection lens 3B having a shape that is laterally symmetrical to the projection lens 3A included in the projection lens 3A. For this reason, the refractive surface 11 is provided being offset toward the other side (leftward) in the leftward/rightward direction (horizontal direction) from a position along a lower end portion of the light emission surface 9.

Meanwhile, the refractive surface 11 of the projection lens 3B is constituted by a cut surface configured to refract light L' toward one side (rightward) in the leftward/rightward direction (horizontal direction) with respect to the direction of advance of the light L emitted from the light emission surface 9 and to refract the light L' upward.

Accordingly, in the other lighting tool 1B for a vehicle, as shown in FIG. 8A, with respect to the direction of advance of the light L projected forward from the light emission surface 9 of the projection lens 3B, the light L' refracted by the refractive surface 11 is projected toward the host lane (rightward) in the width direction of the vehicle B as shown in FIG. 8B.

The other lighting tool 1B for a vehicle having the above-mentioned configuration form the light distribution pattern P for a low beam including the cutoff line CL on the upper end using the lights L and L' projected toward the side in front of the projection lens 3B, like the one lighting tool 1A for a vehicle.

The other lighting tool 1B for a vehicle is shifted toward the host lane (rightward) in the width direction of the vehicle B while shifting the brightness boundary of the cutoff line CL upward using the light L' refracted by the refractive surface 11, like the one lighting tool 1A for a vehicle.

Here, the projection lens 3A included in the one lighting tool 1A for a vehicle and the projection lens 3A included in the other lighting tool 1A for a vehicle are matched with the slant shapes applied to corner sections on the side of the front end of the vehicle B as shown in FIG. 1B, and has a shape in which light emission surfaces 11 are inclined in opposite directions in a direction in which an outward side (the other end side) of the width direction (horizontal direction) of the vehicle B is retracted further than the inward side (one end side) with respect to the direction of advance of the vehicle B (the direction of advance of the light L emitted from the light emission surfaces 11).

In this case, a refractive surface 9 of a projection lens 3A and a refractive surface 9 of a projection lens 3B have asymmetrical shapes in the horizontal cross section. That is, at least one sides of the respective refractive surfaces 9 (one surface when seen in a front view) are inclined in opposite directions.

Accordingly, even when the reference point S of laws and regulations is located in the cutoff line CL shifted rightward and upward, since there is no blurred cutoff line CL, it is possible to prevent the light intensity of the reference point S from exceeding the reference value when the light intensity of the reference point S is measured. As a result, it is possible to obtain a good light distribution pattern P for a low beam.

Further, the present invention is not necessarily limited to the embodiment and various modifications may be made without departing from the scope of the present invention.

For example, the refractive surface 11 is not limited to the configuration of refracting the light L' upward with respect to the direction of advance of the light L emitted from the light emission surface 9, and may have a configuration in which a diffusion section is configured to diffuse the light in the upward/downward direction (vertical direction).

In addition, the lighting tool for a vehicle to which the present invention is applied is not limited to the above-mentioned configuration, and for example, may have a configuration including a light source, a reflector configured to reflect light emitted from the light source in a direction of advance of the vehicle, a shade configured to shield (cut) some of the light reflected by the reflector, and a projection lens configured to project the light, some of which is cut by the shade in the direction of advance of the vehicle.

Figure 9:
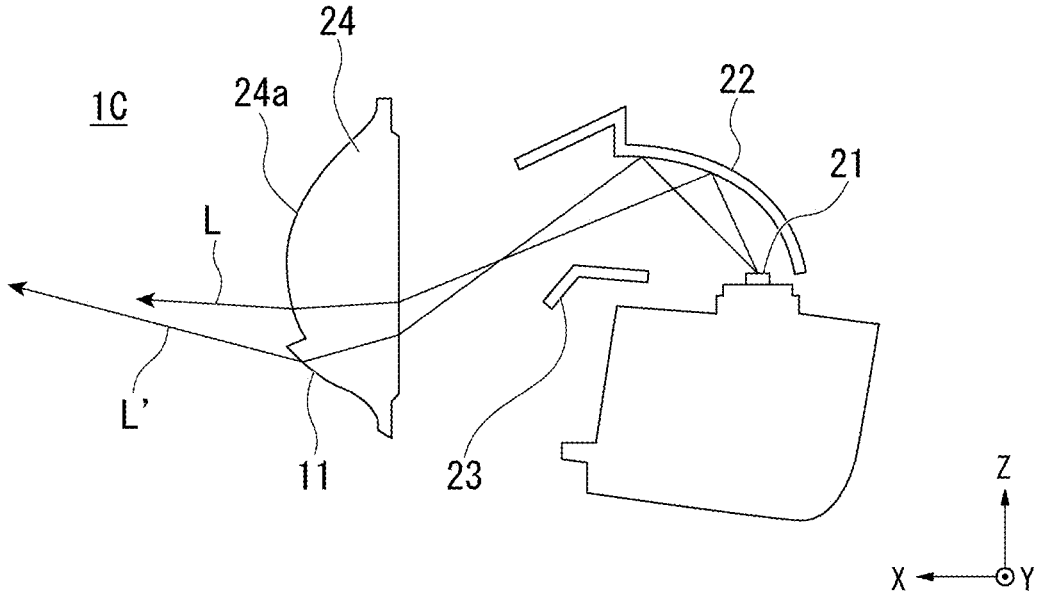
FIG. 9 is a cross-sectional view showing a configuration of a reflector type lighting tool for a vehicle.
Figure 10:
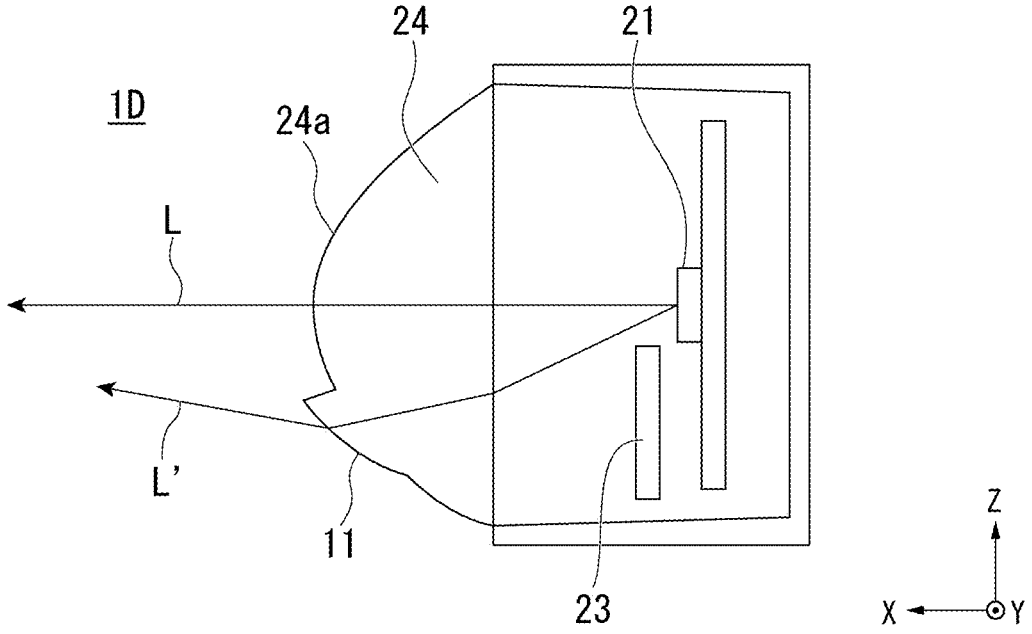
FIG. 10 is a cross-sectional view showing a configuration of a direct projection type lighting tool for a vehicle.

Specifically, the present invention may be applied to a projector type lighting tool 1C for a vehicle shown in FIG. 9, or a direct projection type lighting tool 1D for a vehicle shown in FIG. 10.

As shown in FIG. 9, the projector type lighting tool 1C for a vehicle includes a light source 21, a reflector 22, a shade 23 and a projection lens 24, the light L emitted from the light source 21 is reflected by the reflector 22 and then condensed in the vicinity of the focus of the projection lens 24, some of the light L is shielded by the shade 23, and thus, the light distribution pattern for a low beam is formed.

As shown in FIG. 10, the direct projection type lighting tool ID for a vehicle has the light source 21, the shade 23 and the projection lens 24, the light L emitted from the light source 21 is condensed in the vicinity of the focus of the projection lens 24, some of the light L is shielded by the shade 23, and thus, the light distribution pattern for a low beam is formed.

In the projector type lighting tool 1C for a vehicle shown in FIG. 9 and the direct projection type lighting tool 1D for a vehicle shown in FIG. 10, the above mentioned refractive surface 11 is provided on a light emission surface 24*a* of the projection lenses 24, respectively.

Specifically, the refractive surface 11 is provided in a lower region of the light emission surface 24*a*, and has a cut surface shape curved rearward in order to refract the light L' entering the lower side of the light emission surface 24*a* upward. In addition, the refractive surface 11 is similar in shape to the lower region of the light emission surface 24*a* constituted by the lens surface curved in a convex shape. For this reason, providing the refractive surface 11 in the lower region of the light emission surface 24*a* enables the light L' refracted upward easily while suppressing the forward protrusion of the refractive surface 11 at a low level. Further, it is possible to more easily refract the light L' upward by providing the refractive surface 11 at the position which is along the lower end portion of the light emission surface 24*a*.

The lighting tools 1C and 1D for a vehicle of the embodiment having the above-mentioned configuration form the light distribution pattern P for a low beam including the cutoff line CL on the upper end by using lights L and L' projected toward the side in front of the projection lens 24, like the case shown in FIG. 7A.

Figure 11A:
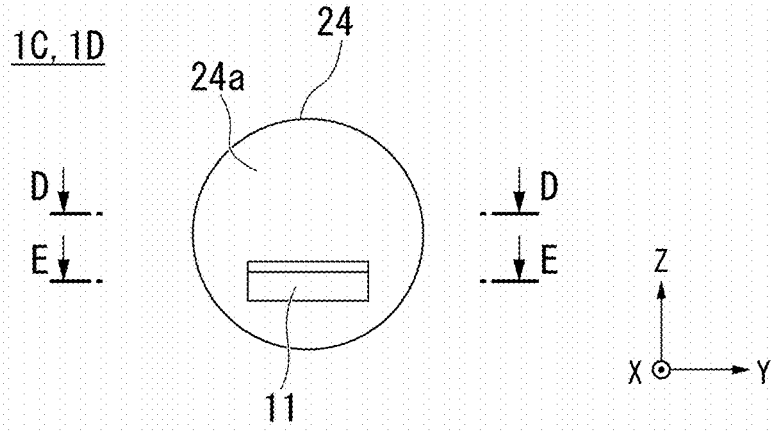
FIG. 11A is a front view of a configuration of a projection lens on the right side included in the lighting tool for a vehicle shown in FIG. 9 and FIG. 10.
Figure 11B:
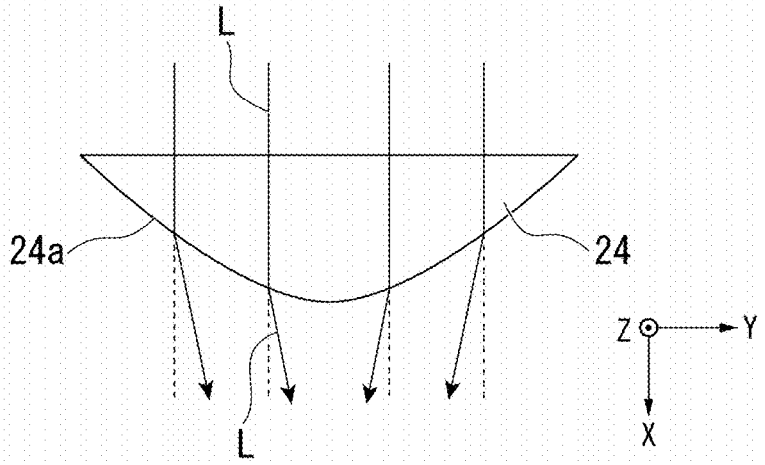
FIG. 11B is a schematic view showing a configuration of the projection lens on the right side included in the lighting tool for a vehicle shown in FIG. 9 and FIG. 10, and showing an optical path of light projected toward a side in front of the projection lens in a horizontal cross section along a line segment D-D shown in FIG. 11A.
Figure 11C:
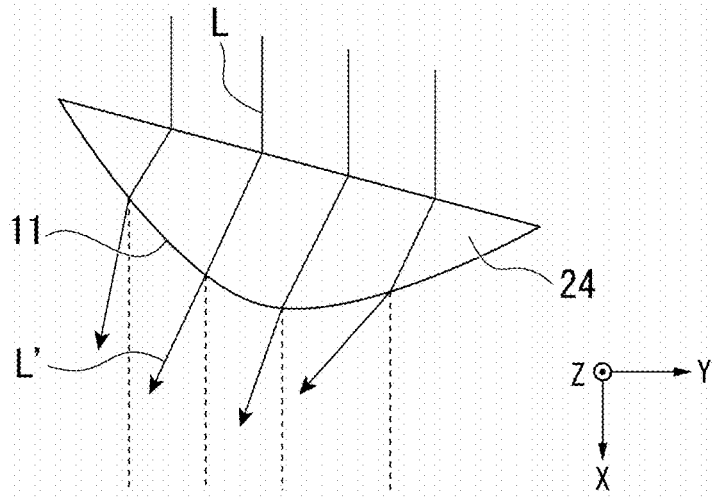
FIG. 11C is a schematic view showing a configuration of the projection lens on the right side included in the lighting tool for a vehicle shown in FIG. 9 and FIG. 10, and showing an optical path of light projected toward a side in front of the projection lens in a horizontal cross section by a line segment E-E shown in FIG. 11A.
Figure 12A:
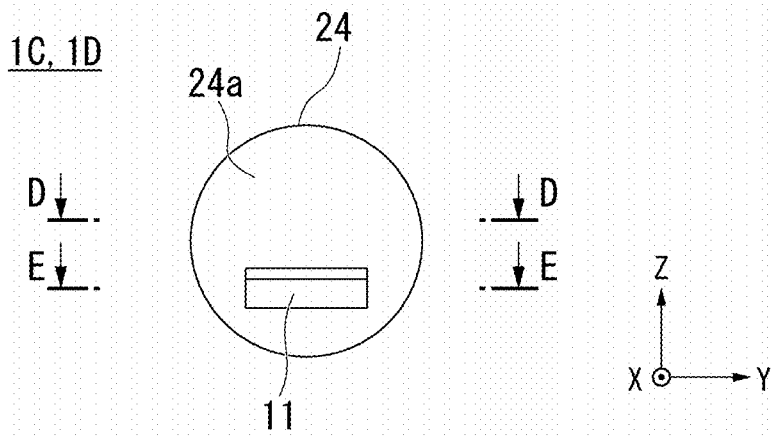
FIG. 12A is a front view of a configuration of a projection lens on the left side included in the lighting tool for a vehicle shown in FIG. 9 and FIG. 10.
Figure 12B:
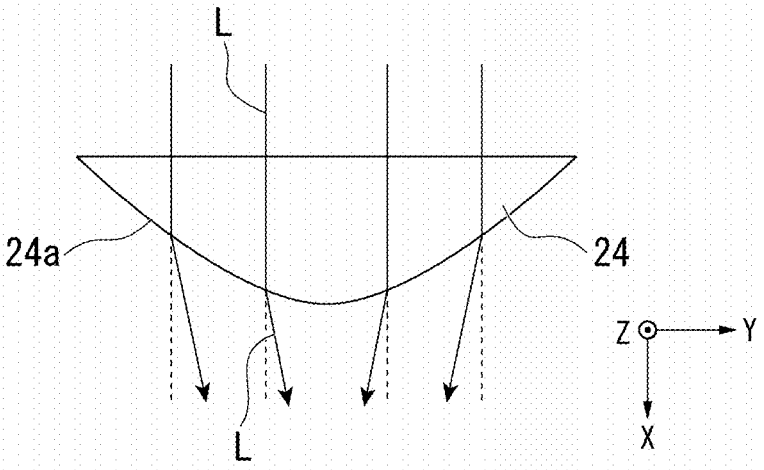
FIG. 12B is a schematic view showing a configuration of the projection lens on the left side included in the lighting tool for a vehicle shown in FIG. 9 and FIG. 10, and showing an optical path of light projected toward a side in front of the projection lens in a horizontal cross section by a segment D-D shown in FIG. 12A.
Figure 12C:
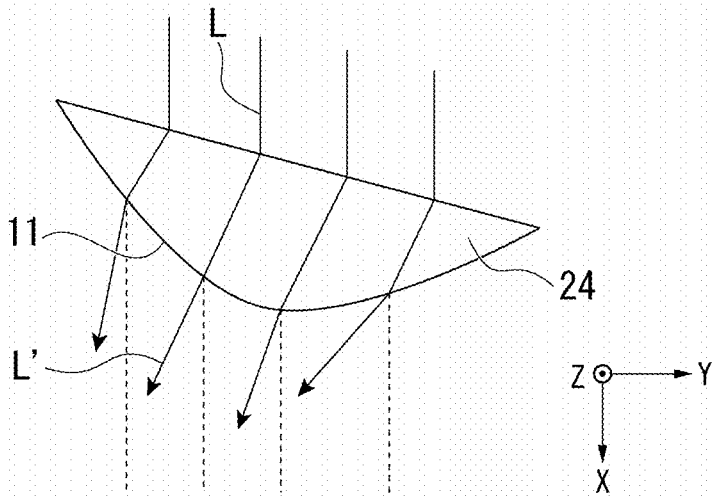
FIG. 12C is a schematic view showing a configuration of the projection lens on the left side included in the lighting tool for a vehicle shown in FIG. 9 and FIG. 10, and showing an optical path of light projected toward a side in front of the projection lens in a horizontal cross section along a line segment E-E shown in FIG. 12A.

In addition, in the lighting tools 1C and 1D for a vehicle of the embodiment, as shown in FIG. 11A and FIG. 12A, when the vehicle B travels according to right-hand side lane traffic, the light L' refracted by the refractive surface 11 is projected toward the host lane (rightward) in the width direction of the vehicle B as shown in FIG. 11C and FIG. 12C with respect to the direction of advance of the light L projected forward from the light emission surface 24*a* of the projection lens 24 as shown in FIG. 11B and FIG. 12B.

Further, FIG. 11A is a front view of a configuration of the projection lens 24 on the right side included in the lighting tools 1C and 1D for a vehicle shown in FIG. 9 and FIG. 10. FIG. 11B is a schematic view showing an optical path of light L projected toward the side in front of the projection lens 24 in a horizontal cross section along line segment D-D shown in FIG. 11A. FIG. 11C is a schematic view showing an optical path of light L' projected toward the side in front of the projection lens 24 in a horizontal cross section along line segment E-E shown in FIG. 11A. In addition, FIG. 12A is a front view of a configuration of the projection lens 24 on the left side included in the lighting tools 1C and 1D for a vehicle shown in FIG. 9 and FIG. 10. FIG. 12B is a schematic view showing an optical path of light L projected toward the side in front of the projection lens 24 in a horizontal cross section along line segment D-D shown in FIG. 12A. FIG. 12C is a schematic view showing an optical path of light L' projected toward the side in front of the projection lens 24 in a horizontal cross section along line segment E-E shown in FIG. 12A.

As shown in FIG. 7A, in the vehicle B traveling according to right-hand side lane traffic, when the refractive surface 11 is provided on the light emission surface 24*a*, the cutoff line CL on the upward side is shifted toward the host lane (rightward) in the width direction of the vehicle B while the brightness boundary of the cutoff line CL is shifted upward by the light L' refracted by the refractive surface 11.

In this case, even when the reference point S of laws and regulations is located in the cutoff line CL which is shifted rightward and upward, since there is no blurred cutoff line CL, it is possible to prevent the light intensity of the reference point S from exceeding the reference value when the light intensity of the reference point S is measured. As a result, it is possible to obtain a good light distribution pattern P for a low beam.

In addition, the reference point S is disposed in the vicinity of a center which exceeds 0° of line V-V of the light intensity distribution and which is less than 0° of line H-H. Meanwhile, the reference point S is not limited to such as a position and may be disposed in the vicinity of a center which exceeds 0° of line V-V and which exceeds 0° of line H-H.

In such case, while shifting the brightness boundary of the cutoff line CL upward and by further shifting such cutoff line CL on the upward side toward the host lane (rightward) in the width direction of the vehicle B, even when the reference point S of laws and regulations is located in, since there is no blurred cutoff line CL, it is possible to prevent the light intensity of the reference point S from exceeding the reference value when the light intensity of the reference point S is measured.

From the above, in a case the reference point S of laws and regulations is provided in the vicinity of the center of line H-H and line V-V, the present invention can be applied.

Meanwhile, in the lighting tools 1C and 1D for a vehicle of the embodiment, in a case the vehicle B travels according to left-hand side lane traffic, the light L' refracted by the refractive surface 11 is projected toward the host lane (leftward) in the width direction of the vehicle B with respect to the direction of advance of the light L projected forward from the light emission surface 24*a* of the projection lens 24. That is, in a case the vehicle B travels according to left-hand side lane traffic, a direction of the light L' refracted by the refractive surface 11 is opposite to that in a case the vehicle B travels according to right-hand side lane traffic.

In such case, the light distribution pattern P for a low beam formed by the light L projected toward the side in front of the projection lens 24 is similar to the case shown in FIG. 7C. That is, as shown in FIG. 7C, even when the reference point S' of laws and regulations is located in the cutoff line CL which is shifted leftward and upward, since there is no blurred cutoff line CL, it is possible to prevent the light intensity of the reference point S' from exceeding the reference value when the light intensity of the reference point S' is measured. As a result, it is possible to obtain a good light distribution pattern P for a low beam.

In addition, the reference point S' is disposed in the vicinity of a center which exceeds 0° of line V-V and which exceeds 0° of line H-H. Meanwhile, the reference point S' is not limited to such a position, and the reference point S' may be disposed in the vicinity of a center which is less than 0° of line V-V and which exceeds 0° of line H-H.

In this case, while shifting the brightness boundary of the cutoff line CL upward and by further shifting the cutoff line CL on the upward side toward the host lane (leftward) in the width direction of the vehicle B, even when the reference point S' of laws and regulations is located in, since there is no blurred cutoff line CL, it is possible to prevent the light intensity of the reference point S' from exceeding the reference value when the light intensity of the reference point S' is measured.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A lighting tool for a vehicle comprising:

a light source; and a projection lens that includes a first lens and a second lens, and that is configured to project light emitted from the light source forward as a light distribution pattern for a low beam which includes a cutoff line at an upper end thereof, wherein the first lens includes a light incidence section to which the light emitted from the light source enters, a reflecting surface that is configured to reflect some of the light entered from the light incidence section and that includes a front end portion which is formed at a front side of the reflecting surface and which is configured to define the cutoff line, and a first light emission surface that is configured to emit the light entered from the light incidence section to an outside, wherein the second lens includes a light incidence surface to which the light emitted to the outside from the first light emission surface enters and a second light emission surface that is configured to emit the light entered from the light incidence surface to an outside, wherein the first lens is configured to emit the light distribution pattern for the low beam which includes the cutoff line at the upper end thereof from the first light emission surface, and wherein a refractive surface that is configured to refract some of the light, which is a light that forms the cutoff line among the light distribution pattern for the low beam entered from the light incidence surface, toward one side in a horizontal direction with respect to an advancing direction of the light emitted from the second light emission surface and that is configured to refract the some of the light upward is provided on the second light emission surface.

2. The lighting tool for a vehicle according to claim 1, wherein, in a case a vehicle travels according to a right-hand side lane traffic, the refractive surface refracts light rightward with respect to the advancing direction of the light emitted from the second light emission surface.

3. The lighting tool for a vehicle according to claim 2, wherein the some of the light of the cutoff line, which is shifted rightward and upward by the refraction at the refractive surface, is shifted from a vicinity of a center that exceeds 0° of line V-V of a light intensity distribution and that is less than 0° of line H-H of the light intensity distribution.

4. The lighting tool for a vehicle according to claim 1, wherein, in a case a vehicle travels according to a left-hand side lane traffic, the refractive surface refracts light leftward with respect to the advancing direction of the light emitted from the second light emission surface.

5. The lighting tool for a vehicle according to claim 4, wherein the some of the light of the cutoff line, which is shifted leftward and upward by the refraction at the refractive surface, is shifted from a vicinity of a center that exceeds 0° of line V-V of a light intensity distribution and that exceeds 0° of line H-H of the light intensity distribution.

6. The lighting tool for a vehicle according to claim 1, wherein the refractive surface includes a diffusion section configured to diffuse light in a vertical direction with respect to the advancing direction of the light emitted from the second light emission surface.

7. The lighting tool for a vehicle according to claim 1, wherein the second light emission surface of the second lens configures a convex lens surface, and the refractive surface is provided in a lower region of the second light emission surface.

8. The lighting tool for a vehicle according to claim 1, wherein the refractive surfaces refract light in same direction in the respective projection lenses included in a pair of lighting tools for a vehicle mounted on both of left and right sides on a front end side of a vehicle.

9. The lighting tool for a vehicle according to claim 1, wherein the projection lens has a shape in which the second light emission surface is inclined in a direction in which other end side in a horizontal direction is retracted than one end side in the horizontal direction with respect to an advancing direction of the light emitted from the second light emission surface so as to match a slant shape applied at a corner section on a front end side of a vehicle, and the refractive surfaces have an asymmetrical shape between the respective projection lenses included in a pair of lighting tools for a vehicle mounted on both of left and right sides of a front end side of a vehicle.

* * * * *